US006327798B1

(12) United States Patent
Sakai et al.

(10) Patent No.: US 6,327,798 B1
(45) Date of Patent: Dec. 11, 2001

(54) SNOW SHOVELING MACHINE

(75) Inventors: Seishu Sakai; Yasunori Matsubara; Hiroaki Uchitani, all of Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/531,659

(22) Filed: Mar. 20, 2000

(51) Int. Cl.[7] ..... E01H 5/09
(52) U.S. Cl. ..... 37/249; 37/258
(58) Field of Search ..... 37/244, 248, 249, 37/257, 258, 260, 262; 198/638, 640, 641, 642, 657–665, 669–671

(56) References Cited

U.S. PATENT DOCUMENTS

| | | | | |
|---|---|---|---|---|
| 4,203,237 | * | 5/1980 | Enters et al. | 37/248 |
| 4,322,896 | * | 4/1982 | Miyazawa et al. | 37/249 |
| 5,758,436 | * | 6/1998 | Harms | 37/249 |
| 5,966,846 | * | 10/1999 | Harms et al. | 37/249 |

FOREIGN PATENT DOCUMENTS

| | | |
|---|---|---|
| 62-63708 | 3/1987 | (JP) . |
| 2556885 | 9/1996 | (JP) . |
| 2556886 | 9/1996 | (JP) . |

* cited by examiner

*Primary Examiner*—Robert E. Pezzuto
(74) *Attorney, Agent, or Firm*—Adams & Wilks

(57) ABSTRACT

A snow shoveling machine comprising an engine and an auger housing accommodating therein an auger paddle. The engine is actuated to thereby rotate the auger paddle. The auger housing includes an upper half and a lower half. The upper half is made from resin. The lower half is formed of a sheet of steel. The upper and lower halves are connected to each other through a connecting member. The connecting member serves a function of reinforcing the auger housing. As snow collected by the auger paddle is thrown upwardly into a snow throwing aperture formed in the upper half, some snow fails to enter the aperture. The connecting member serves to allow such snow to fall to the auger paddle.

29 Claims, 11 Drawing Sheets

SNOW SHOVELING MACHINE

BACKGROUND OF THE INVENTION

1. Field of the Invention

The present invention relates generally to a snow shoveling machine and, more particularly, to a small-sized snow shoveling machine arranged such that when an engine is actuated to rotate an auger paddle accommodated in an auger housing, the auger paddle shovels or collects snow and throws the collected snow out from a shooter extending upwardly from the housing.

2. Description of the Related Art

Various snow shoveling machines have been conventionally known. One example of such snow shoveling machines is disclosed in Japanese Patent Laid-Open Publication No. SHO-62-63708.

The disclosed machine includes a housing in which an engine and an auger paddle are disposed. Actuation of the engine causes the auger paddle to rotate. The auger paddle has auger members provided on right and left sides thereof, and a paddle provided at a central part thereof. The paddle has a surface concavely extending from the right side through the central part to the left side. The central part of the auger paddle serves as a snow throwing portion for throwing collected snow upwardly. As the auger paddle is rotated by the engine, the auger members provided on the opposite sides of the auger paddle carry snow onto the throwing portion. The throwing portion then throws the snow upwardly with a centrifugal force thereof exerted to the snow. The thus-thrown snow exits the machine by passing through a snow throwing aperture formed in the housing and a shooter.

Some of snow thrown by the thrower fails to enter the snow throwing aperture. Such snow falls onto the auger paddle through snow dropping guides. The auger members then carry the snow to the thrower again. The guides are positioned above the auger paddle. In other words, the guides are provided at a lower part of the shooter.

The auger housing inevitably becomes not only large in size but also complicated in configuration because the housing is required to accommodate the engine and the auger paddle. For this reason, the housing is manufactured typically by press-forming a sheet of steel into halved members and then joining the halved members together by welding or the like.

However, in order to meet an increased demand for an easy-to-manufacture snow shoveling machine having reduced weight, it is desirable to form the auger housing with a resinous upper half forming the snow throwing aperture therein and a lower half made of a sheet of steel to provide sufficient rigidity to support the auger paddle. Also, these halves should be connected together. In addition, it is desirable for the snow dropping guides to be provided in the vicinity of the snow throwing aperture.

The paddle serving as the throwing portion provided at the central part of the auger paddle of the snow shoveling machine disclosed in the aformentioned Publication is difficult to manufacture because the paddle surface has a three-dimensional curved configuration.

In order to solve the above problem associated with the paddle, the present application have proposed a snow shoveling machine as disclosed in Japanese Patent No. 2,556,886.

The disclosed machine includes an auger paddle having valley formed centrally thereof. More specifically, the valley is formed by two flat inclined surfaces to thereby provide a snow throwing portion of V-shaped configuration. The snow throwing portion thus formed by the two inclined surfaces is simple in configuration. Therefore, not only can the auger paddle be produced easily, but snow collected by the auger paddle can be thrown further to thereby provide the machine with improved snow-removing performance.

Although the thus-constructed machine serves to collect snow at the snow throwing portion of substantially V-shaped configuration and to then throw the snow further throw in other snow throwing configurations, there is still room for improvement of the function of collecting and throwing snow.

SUMMARY OF THE INVENTION

A first object of the present invention is to provide a snow shoveling machine which is constructed such that a connecting member for connecting together upper and lower halves of an auger housing serves as a snow dropping guide to thereby reduce the number of parts for the machine, and which provides an improved function of removing snow.

A second object of the present invention is to provide a snow shoveling machine which has an easy-to-manufacture auger paddle of simple construction and which provides an improved function of collecting and throwing snow.

According to a first aspect of the present invention, there is provided a snow shoveling machine comprising an auger housing, an auger paddle disposed within the auger housing, and a motive power source for rotating the auger paddle when actuated, wherein the auger paddle collects snow and throws the collected snow out from a snow throwing aperture formed in the auger housing, the auger housing including an upper half having the snow throwing aperture, a lower half for supporting the auger paddle, and a connecting member for connecting the upper half and the lower half together, the connecting member being disposed forwardly of the snow throwing aperture and serving as a snow dropping guide.

The connecting member thus connecting the upper and lower halves together serves as a reinforcing member for the auger housing, whereby the auger housing provides improved rigidity. The connecting member also serves as the snow dropping guide. This eliminates the need to provide a reinforcing member and a snow dropping member separately to thereby contribute to a reduction in the number of parts for the machine.

In a preferred form, the upper half is made of resin to thereby reduce the weight of the auger housing and also facilitate forming of the auger housing. The lower half is formed of a sheet of steel to provide rigidity required to support the auger paddle. The auger housing has the connecting member provided therein and extending along the width thereof. The connecting member thus serves as a beam, whereby the auger housing provides improved rigidity even when the upper half is made of resin.

Preferably, the connecting member is disposed forwardly of and above the auger paddle, the connecting member being spaced from the auger paddle by a predetermined distance, the connecting member extending forwardly from and downwardly from the upper half in such a manner as to continue to an inner peripheral surface of the upper half.

Thus, even when snow thrown upwardly by the auger paddle fails to enter the snow throwing aperture, the snow is allowed to fall by means of the connecting member thus arranged.

According to a second aspect of the present invention, there is provided a snow shoveling machine for collecting thereat snow and throwing the snow out of a shooter, the machine comprising: an auger paddle rotated by a drive source when the drive source is actuated; an auger housing having the auger paddle rotatably accommodated therein and the shooter extending upwardly therefrom; the auger paddle having a pair of helical members disposed on opposite sides of a shaft of the auger paddle and a snow thrower disposed at a central portion of the auger paddle positioned between the helical members, wherein the helical members carry snow to the central portion of the auger paddle and the snow thrower throws the snow upwardly; and the snow thrower having a pocket portion formed thereat, the pocket portion having a predetermined depth extending opposite to a direction of rotation of the snow thrower, the pocket portion being opened outwardly and in the direction of rotation of the snow thrower.

By virtue of the pocket portion, the snow thrower can collect thereat snow in larger amounts and throw the same.

In a preferred form of the present invention, the pocket portion has a bottom portion inclined opposite to a direction of rotation of the auger paddle to thereby provide a lag angle. With this arrangement, the snow thrower rotates with the phase of the bottom portion shifted by the lag angle. Therefore, when the snow thrower throws snow, a centrifugal force is applied to the pocket portion of the thrower. As a result, the snow can be thrown further.

In a further preferred form of the present invention, the pocket portion includes a bottom portion having a valley portion formed centrally thereof to provide a substantially V-shaped configuration, the valley portion extending transversely of the bottom portion. Thus, snow can be easily collected at a center portion of the pocket portion. All of the collected snow is then thrown by the snow thrower.

In a still further preferred form of the present invention, the pocket portion includes a bottom portion having a rubber member mounted thereon, the rubber member being adjustable to move transversely of the bottom portion of the snow thrower. Therefore, when the rubber member gets worn, the position of the rubber member can be easily adjusted.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

The following description is merely exemplary in nature and is in no way intended to limit the invention, its application or uses.

Figure 1:
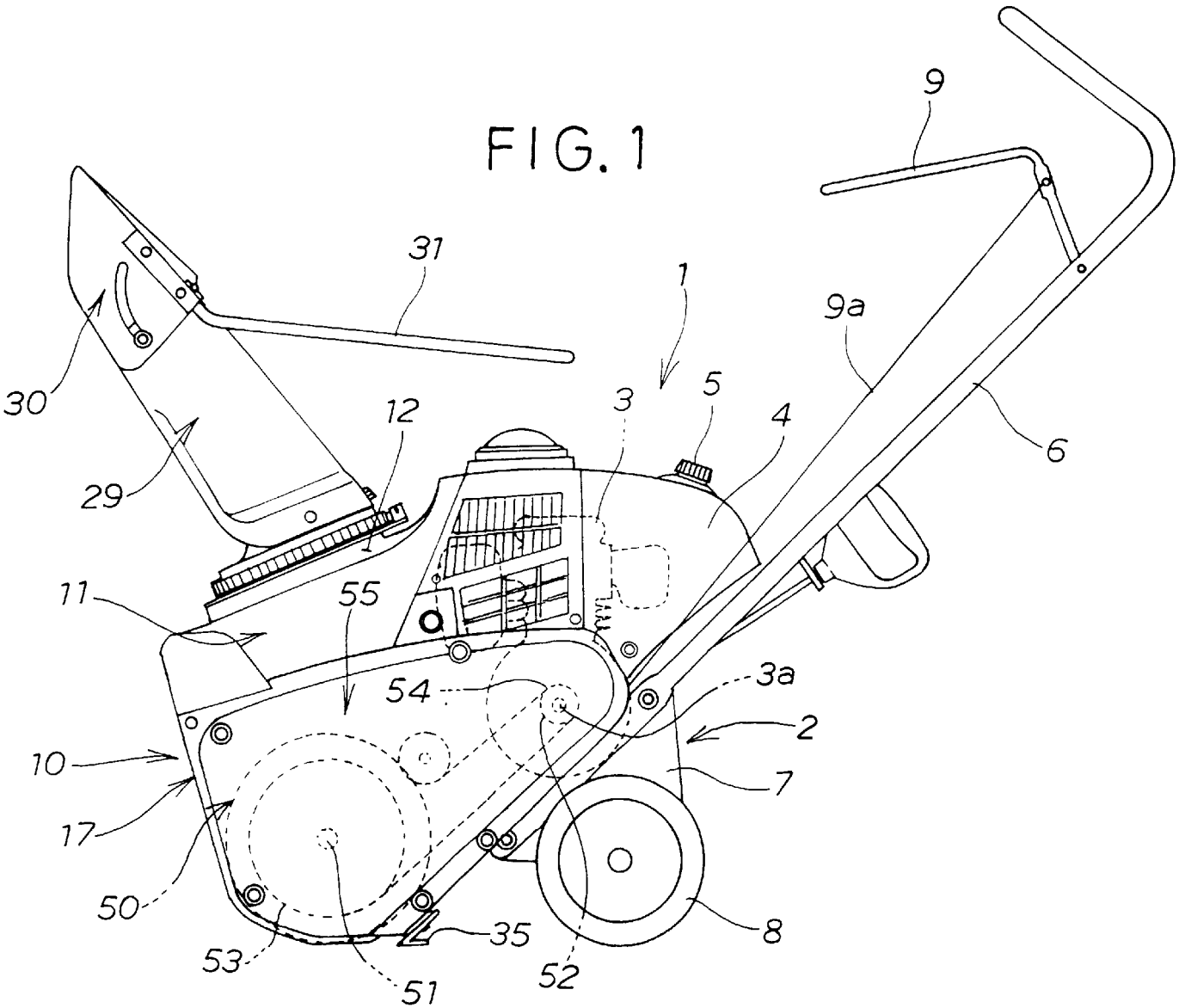
FIG. 1 is a side elevational view of a snow shoveling machine of the present invention.

As shown in FIG. 1, a snow shoveling machine 1 includes an engine 3 carried on a base frame 2. The engine 3 is covered with a cover 4. The cover 4 accommodates therein a fuel tank (not shown). The fuel tank is disposed rearwardly of the engine 3 and supplied with fuel through an inlet thereof. The inlet is closed by a cap 5. The cap 5 is disposed in such a manner as to protrude from the cover 4. The base frame 2 includes at a rear portion thereof an upwardly inclined handle 6 disposed for an operator to operate the machine 1. The handle 6 extends rearwardly from a lower portion of the rear part of the base frame 2. A pair of wheels 8, 8 are mounted rightwardly and leftwardly of a plate 7 forming the lower portion of the base frame 2. The handle 6 has a throttle lever 9 pivotably supported thereon. The throttle lever 9 is operated to open and close a carburetor through a cable 9*a* so as to control an output of the engine 3.

The machine 1 has an auger housing 10 disposed at a front part thereof. The auger housing 10 is opened upwardly and forwardly. The auger housing 10 is halved to form upper and lower halfs 11, 17. Within the auger housing 10, an auger paddle 50 is accommodated.

A driving pulley 52 is mounted on an output shaft 3*a* of the engine 3. The driving pulley 52 is connected to a driven pulley 53 via a belt 54. The driven pulley 53 is connected to a shaft 51 of the auger paddle 50. The engine 3 is actuated to rotate the driving pulley 52, thereby rotating the driven pulley 53 through the belt 54. Rotation of the driven pulley 53 causes the auger paddle 50 to rotate. The driving pulley 52, the belt 54, and the driven pulley 53 cooperate with each other to form a belt and pulley mechanism. The belt and pulley mechanism is disposed leftwardly within the lower half 17 as viewed in the direction of travel of the machine 1. The mechanism has its outside covered with a side cover 55.

Discussion will be made next as to the configuration and construction of the upper half 11 forming the auger housing 10.

Figure 3:
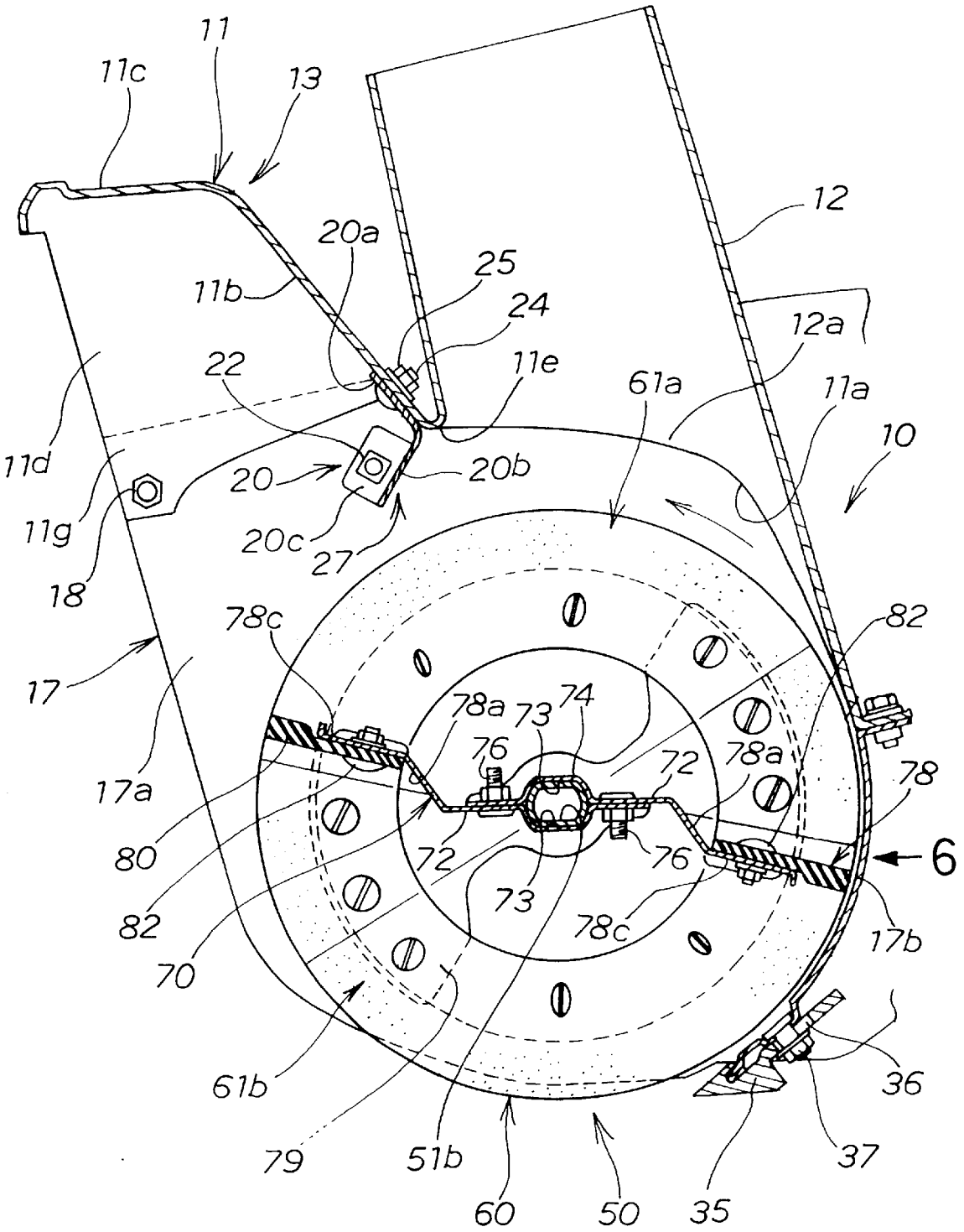
FIG. 3 is an enlarged vertical cross-sectional view of an auger housing, shown in FIG. 1, and an auger paddle accommodated within the auger housing.

In the illustrated embodiment, the upper half 11 is formed of resinous material so as to make the auger housing 10 lightweight. The upper half 11 includes a snow throwing duct 12 disposed at a widthwise central portion thereof. The duct 12 is formed integrally with the auger housing 10. The width of the duct 12 is approximately half that of the auger housing 10. The duct 12 has an opened portion serves as a snow throwing aperture 12*a* communicating with the auger housing 10, as shown in FIG. 3. As is apparent from FIG. 11, the duct 12 is small in height and includes upper and lower parts having small and large widths, respectively, to thereby provide a trapezoidal configuration. The duct 12 has a shooter 29 mounted on the upper part thereof. The shooter 29 can be turned in such a manner as to vary the direction of travel of snow thrown out of the duct 12. Provided on an upper part of the shooter 29 is a guide corn 30 which is movable along a longitudinal direction of the shooter 29 so as to adjust the height of the shooter 29. The guide corn 30 to move longitudinally of the shooter 29.

Figure 4:
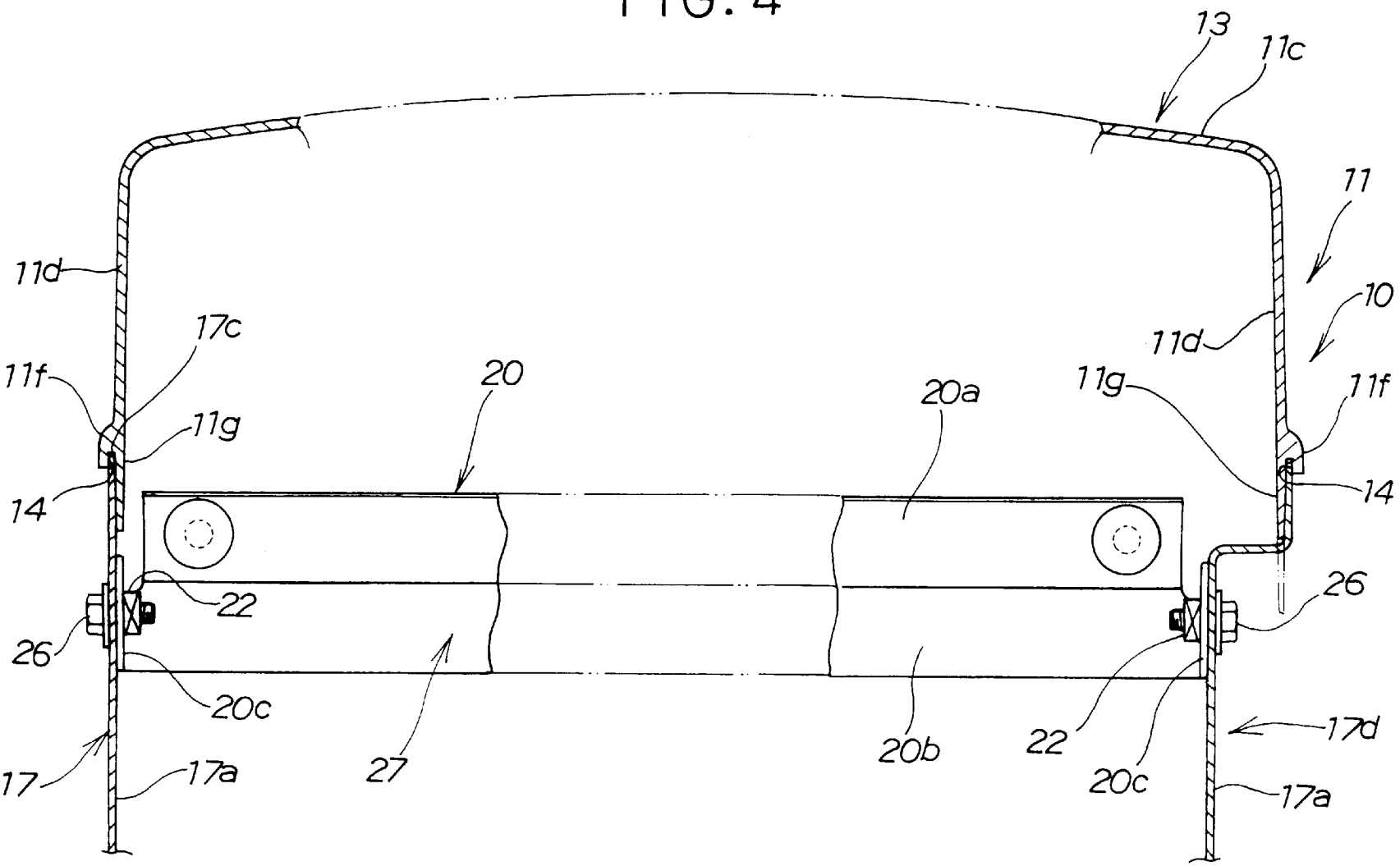
FIG. 4 is a vertical cross-sectional view of upper and lower halves of the auger housing of FIG. 3 connected together.
Figure 5:
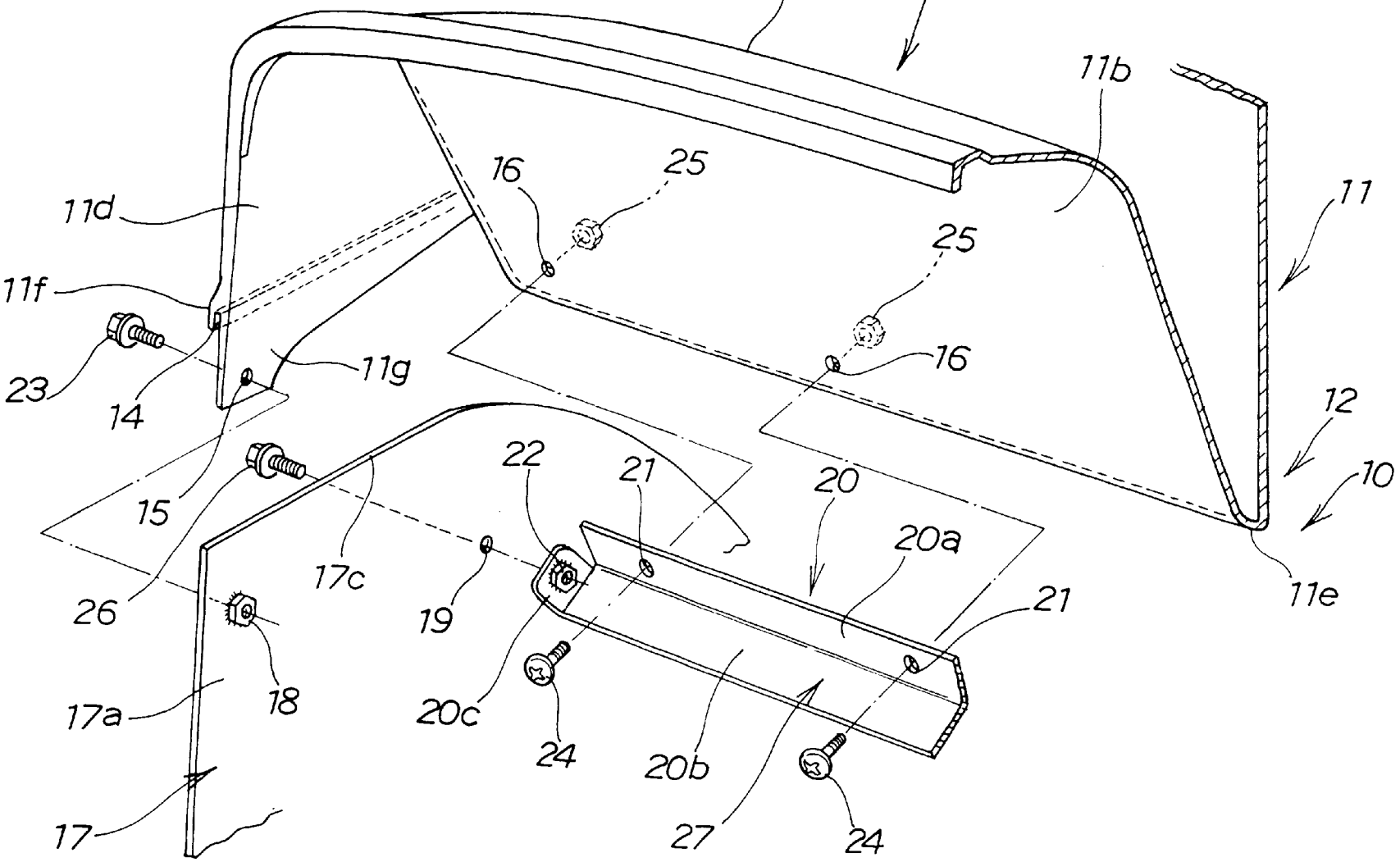
FIG. 5 is an exploded perspective view of a connecting member and the upper and lower halves shown in FIG. 4.

Referring to FIG. 3, the duct 12 has a lower surface 11*a* extending transversely thereof. The lower surface 11*a* is convexly curved. The upper half 11 includes a roof portion 13 disposed forwardly of the duct 12. The roof portion 13 has a rear wall 11*b* extending obliquely and forwardly, and an upper wall 11*c* extending forwardly from an upper end portion of the rear wall 11*b*, as best shown in FIG. 5. The rear and upper walls 11*b*, 11*c* extend along the entire width of the roof portion 13. The roof portion 13 includes side walls 11*d*, 11*d* provided rightwardly and leftwardly thereof, as shown in FIG. 4. A first half portion of the upper half 11 has the roof portion 13 while a second half portion of the upper half 11 has the duct 12. The first and second half portions provide a boundary part 11*e* therebetween. The boundary part 11*e* is bent to have a U-shaped configuration. The duct 12 is contiguous with the roof portion 13 through the boundary part 11*e*.

The side walls 11*d*, 11*d* provided rightwardly and leftwardly of the roof portion 13, respectively, have outwardly bulged ribs 11*f*, 11*f* formed on lower side surfaces thereof, respectively, as shown in FIGS. 4 and 5. The ribs 11*f*, 11*f* extend longitudinally of the machine 1. The ribs 11*f*, 11*f* have engagement grooves 14, 14 opened downwardly. The side walls 11*d*, 11*d* of the roof portion 13 have projecting pieces 11*g*, 11*g* provided at front parts thereof. The projecting pieces 11*g*, 11*g* are formed integrally with and extend downwardly from the front parts of the side walls 11*d*, 11*d*.

Turning to FIG. 5, each projecting piece 11*g* forms therein a mounting aperture 15 through which a bolt 23 passes. Formed in a lower portion of the rear wall 11*b* forming the roof portion 13 are plural mounting apertures 16 through which bolts 24 pass.

Discussion will be made next as to the configuration and construction of the lower half 17 forming the auger housing 10.

Figure 2:
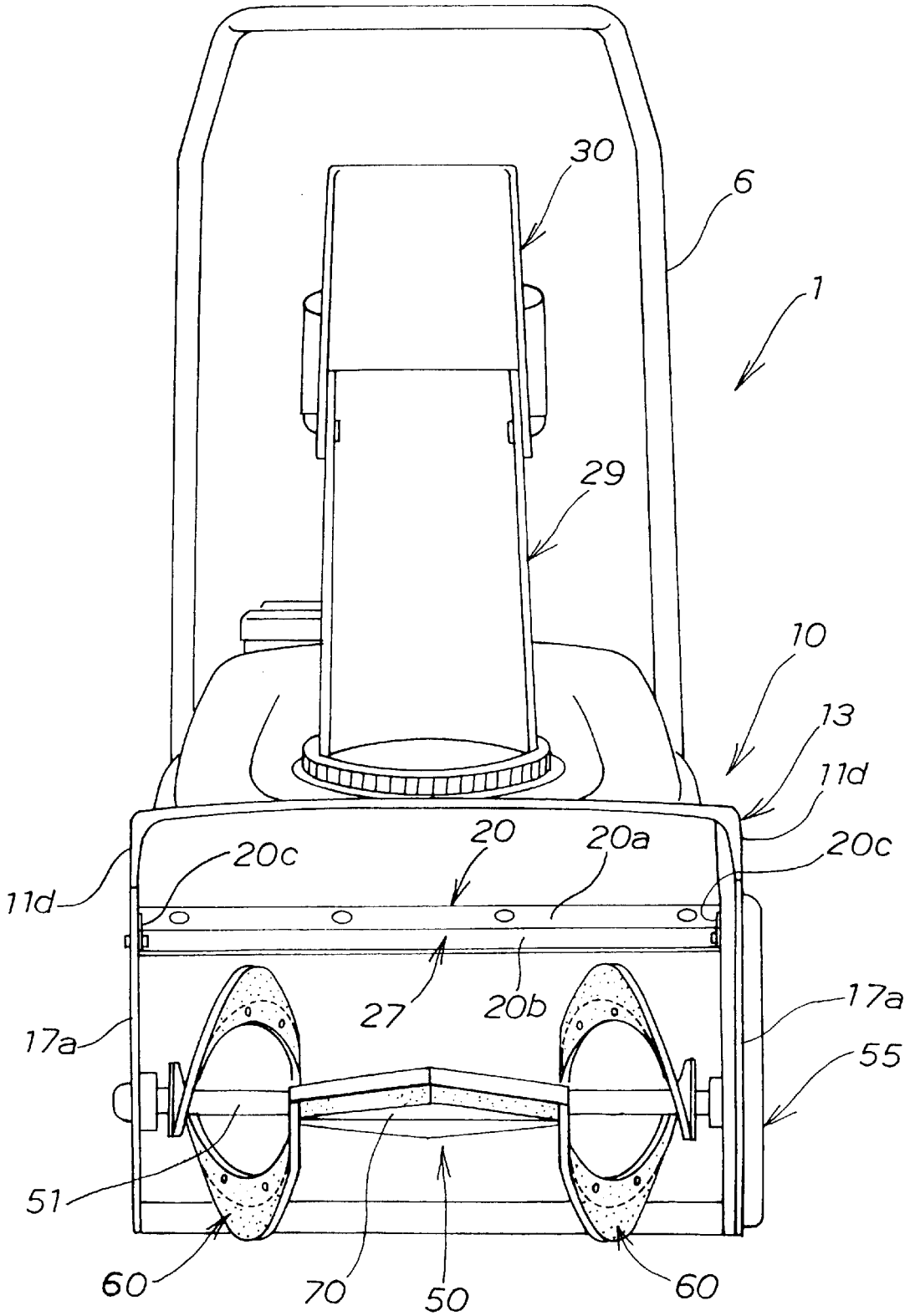
FIG. 2 is a front elevational view of the machine shown in FIG. 1.

In the illustrated embodiment, the lower half 17 is formed of a sheet of steel so as to provide the auger housing 10 with increased rigidity. The lower half 17 includes right and left side walls 17*a*, 17*a* as shown in FIG. 2, and a rear wall 17*b* formed integrally with the side walls 17*a*, 17*a*, as shown in FIG. 3. The rear wall 17*b* extends between lower portions of rear parts of the side walls 17*a*, 17*a*. The lower half 17 is opened at an upper half of a rear part thereof. Thus, the lower half 17 and the duct 12 communicate with each other.

As shown in FIG. 5, each side wall 17*a* has a weld nut 18 provided on an upper portion of a front part thereof, and a mounting aperture 19 provided backwardly of the weld nut 18. More specifically, the weld nut 18 corresponds to the mounting aperture 15 formed in the projecting piece 11*g* of the upper half 11. A bolt 26 passes through the mounting aperture 19.

Laid between the right and left side walls 17*a*, 17*a* of the lower half 17 is a connecting member 20 as shown in FIG. 2 through FIG. 5. The connecting member 20 is formed of a sheet of steel material having an L-shaped cross-section. That is, the connecting member 20 has an upright upper piece 20*a*, a lower piece 20*b* extending from a lower end portion of the upper piece 20*a*, and right and left side pieces 20*c*, 20*c* provided uprightly on right and left ends of the lower piece 20*b*, respectively. The lower piece 20*b* is perpendicular to and integral with the upper piece 20*a*. The side pieces 20*c*, 20*c* are integral with the lower piece 20*b*. The upper piece 20*a* has plural mounting apertures 21 formed in such a position as to correspond to the plural mounting apertures 16 formed in the lower portion of the rear wall 11*b* of the upper half 11. Weld nuts 22, 22 are provided inside the right and left side pieces 20*c*, 20*c* in such a manner as to correspond to the mounting apertures 19 formed in the side walls 17*a*, 17*a* of the lower half 17.

For coupling the upper and lower halfs 11, 17 together, as shown in FIG. 4, upper end portions 17*c*, 17*c* of the right and left side walls 17*a*, 17*a* of the lower half 17 are fitted into the grooves 14, 14 formed in the ribs 11*f*, 11*f* provided outside the right and left side walls 11*d*, 11*d*, whereafter the bolts 23, 23 are screwed into the weld nuts 18, 18, provided on the side walls 17*a*, 17*a*, through the mounting apertures 15, 15 formed in the projecting pieces 11*g*, 11*g*, as shown in FIG. 5.

Thereafter, the bolts 24 are screwed into nuts 25 through the mounting apertures 21, 16 formed in the upper piece 20*a* of the connecting member 20 and in the rear wall llb of the upper half 11, respectively. The connecting member 20 is thus secured to the lower portion of the rear wall 11*b*.

Subsequently, the weld nuts 22 provided on the side pieces 20*c*, 20*c* of the connecting member 20 are aligned with the mounting apertures 19 formed in the side walls 17*a*, 17*a* of the lower half 17. The bolts 26 are then screwed into the weld nuts 22 through the mounting apertures 19. The side walls 17*a*, 17*a* of the lower half 17 are therefore coupled to opposite end portions of the connecting member 20.

Inside the upper half 11 formed of resin, the connecting member 20 extends along the entire width of the upper half 11. The connecting member 20 thus extending throughout the width of the upper half 11 serves as a beam member for the upper half 11. By thus providing the beam member, the upper half 11 provides improved widthwise rigidity. The connecting member 20 also serves as a cross member for the lower half 17, whereby the side walls 17*a*, 17*a* of the lower half 17 are increased in rigidity.

The lower piece 20*b* of the connecting member 20 is disposed at the lower portion of the rear wall 11*b* of the roof portion 13 of the upper half 11, as shown in FIG. 3. That is, since the lower piece 20*b* is disposed in the vicinity of the boundary part 11*e* formed between the duct 12 and the roof portion 13, the lower piece 20*b* is contiguous with the curved lower surface 11*a* of the duct 12.

The lower piece 20*b* of the connecting member 20 serves as a snow dropping guide member 27 disposed such that as the auger paddle 50 described hereinafter collects snow and throws the collected snow out of the duct 12 through the aperture 12*a*, some snow which fails to enter the aperture 12*a* impacts on the lower piece 20*b* and falls to the auger paddle 50 positioned below the lower piece 20*b*.

As shown in FIG. 4, the left side wall 17*a* (the right side wall 17*a* in this figure) of the auger housing 10 has a recessed portion 17*d* provided at an upper part thereof. That is, the upper part of the side wall 17*a* is recessed to define a space for accommodating the belt and pulley mechanism for rotating the auger paddle 50.

Within the auger housing 10, the auger paddle 50 is rotatably accommodated. The auger paddle 50 includes the shaft 51 having its opposite end portions rotatably supported by the right and left side walls 17*a*, 17*a* of the lower half 17. The shaft 51 has helical members 60, 60 disposed on both sides thereof, and a snow thrower 70 disposed centrally thereof.

Turning back to FIG. 3, reference numeral 35 denotes a scraper provided at a lower end portion of the rear wall 17*b* of the lower half 17 of the auger housing 10. Although the auger paddle 50 is rotated to remove snow, some snow remains unremoved on the ground to thereby provide irregular ground. The scraper 35 flattens or levels such irregular ground. The scraper 35 has a long aperture 36 formed therein. By loosening a bolt 37, the scraper 35 may be moved along the long aperture 36.

Figure 10:
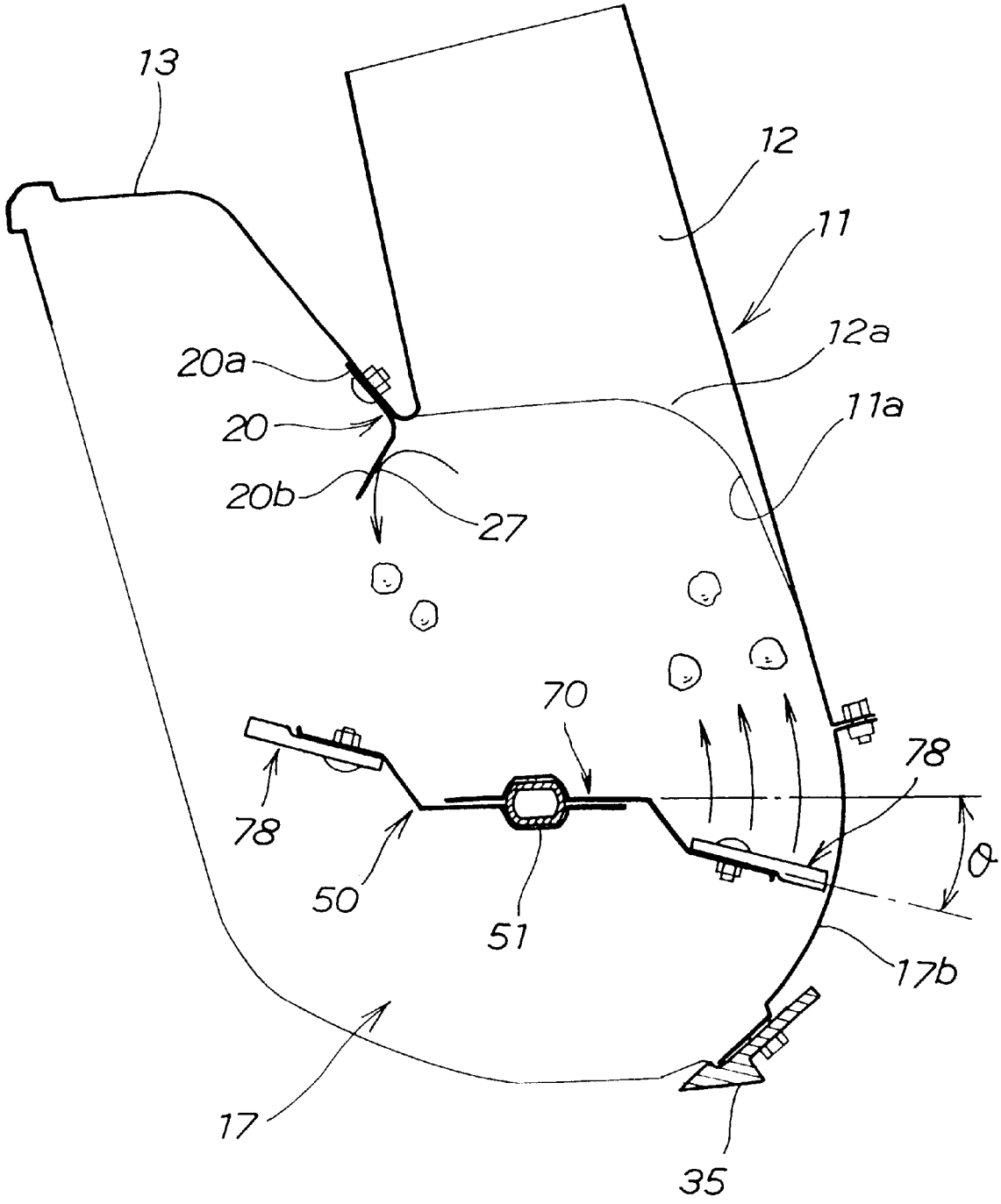
FIG. 10 shows how snow collected by the auger paddle is thrown upwardly into a snow throwing aperture by the snow thrower.
Figure 11:
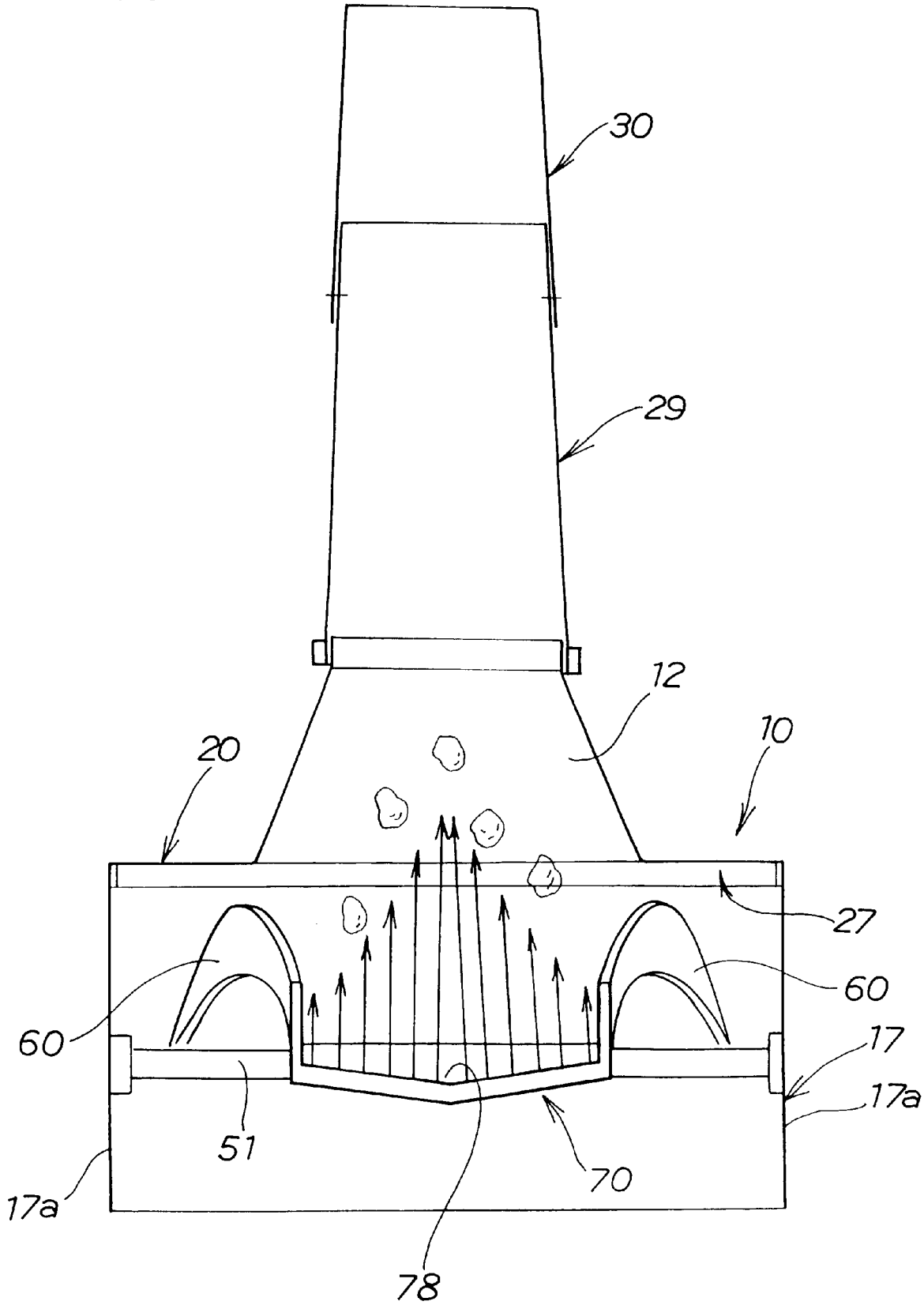
FIG. 11 is a front elevational view of the auger paddle of FIG. 10 wherein snow is thrown by the thrower.

FIGS. 10 and 11 illustrate how snow is removed with the snow shoveling machine 10 of the present invention.

The auger paddle 50 of the machine 10 is rotated to move snow onto the thrower 70 provided centrally thereof. Rotation of the paddle 50 produces a centrifugal force. With such a centrifugal force, the thrower 70 throws the snow out of the shooter 29 (see FIG. 1) through the snow throwing aperture 12*a* of the duct 12 disposed above the thrower 70. As snow is thrown out through the aperture 12*a*, some snow fails to enter the aperture 12*a*. Such snow impacts on the guide member 27 formed from the lower piece 20b of the connecting member 20 provided forwardly of the aperture 12a, as shown in FIG. 10.

The snow impacted on the guide member 27 falls to the paddle 50, as shown in an arrow. Such snow is collected at the thrower 70 by the helical members 60, 60, and then thrown upwardly by the thrower 70 in the manner described above. The guide member 27 is contiguous with the curved lower surface 11*a* of the duct 12 to thereby ensure that snow that fails to enter the duct 12*a* smoothly falls to the auger paddle 50.

The illustrated embodiment has been described as being applied to the upper half 11 made of resin, however, the upper half 11 may be formed by welding together press-formed sheets of steel as is the lower half 17.

Discussion will be made next as to construction of the auger paddle 50 in relation to FIG. 3, and FIGS. 6 to 9.

Figure 6:
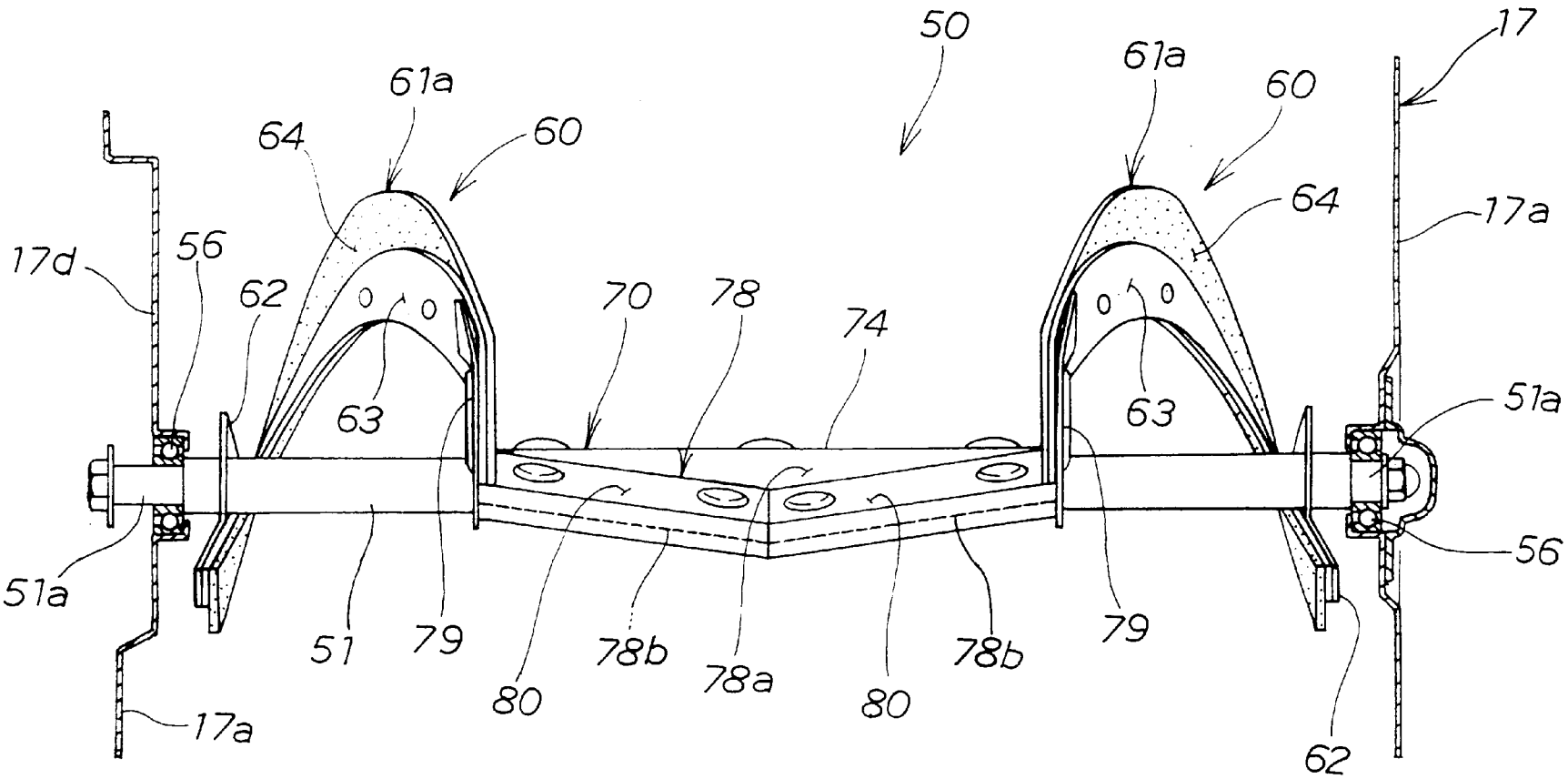
FIG. 6 shows the auger paddle as viewed in a direction indicated by an arrow 6 of FIG. 3, a portion of the paddle being omitted.
Figure 7:
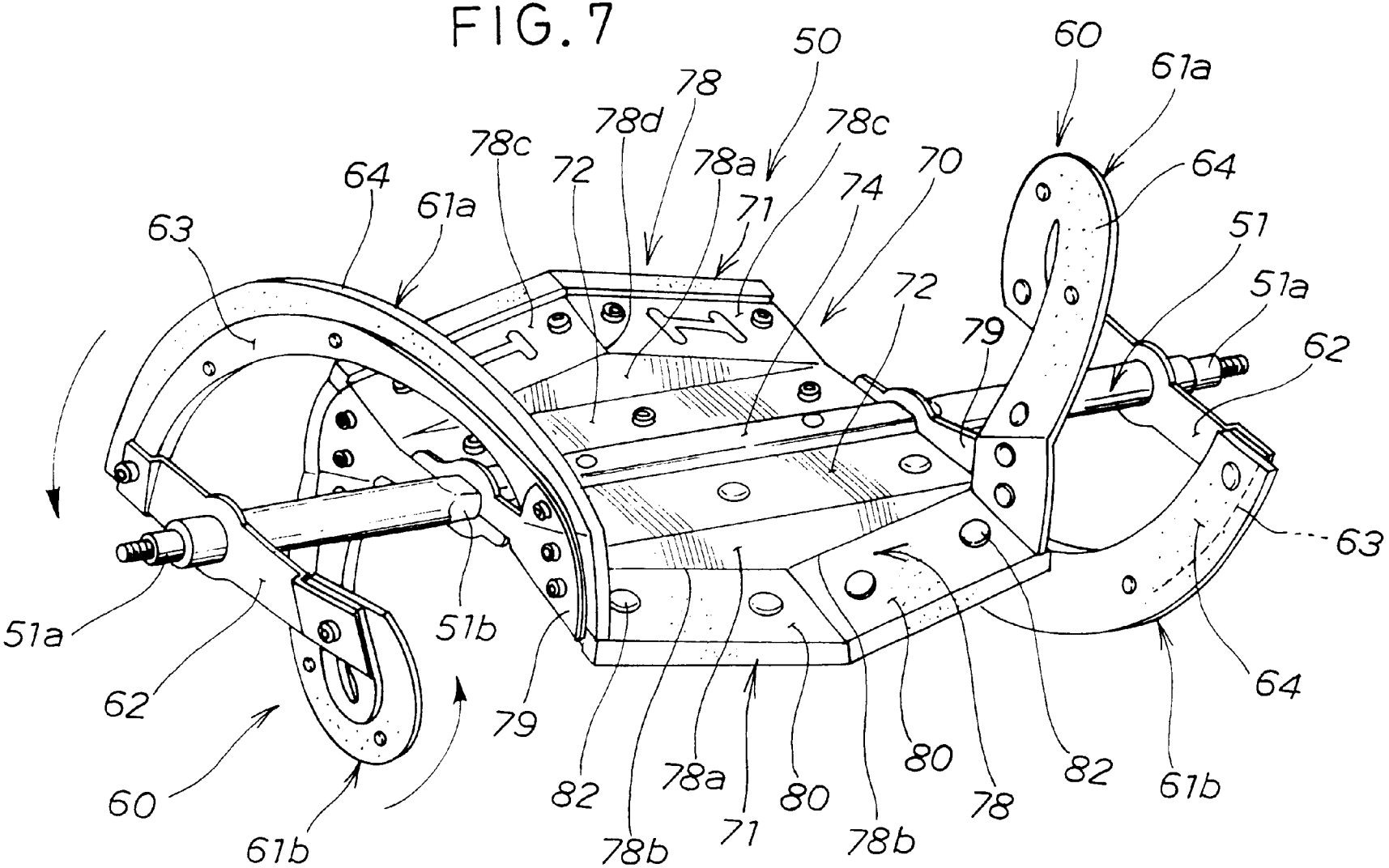
FIG. 7 is a perspective view of the auger paddle shown in FIG. 6.

The auger paddle 50 is rotatably laid between the right and left side walls 17*a*, 17*a* of the lower half 17 of the auger housing 10. The shaft 51 of the auger paddle 50 has an intermediate part 51*b* of rectangular cross-section, as shown in FIG. 7. The intermediate part 51*b* is formed from a pipe material. The shaft 51 has opposite end portions 51*a*, 51*a* rotatably supported on the right and left side walls 17*a*, 17*a* of the lower half 17 through bearings 56, 56, as shown in FIG. 6. The driven pulley 53 as shown in FIG. 1 is received in the recessed portion 17*d* formed at one of the side walls 17*a*, 17*a*, and is connected to one of the end portions 51*a*, 51*a* of the shaft 51. The engine is actuated to rotate the shaft 51 through the driven pulley 53.

The shaft 51 has a pair of the helical members 60, 60 provided rightwardly and leftwardly thereof, respectively, as shown in FIG. 7. The helical members 60, 60 are rotated to cause snow positioned forwardly thereof to move towards the center of the shaft 51. The helical member 60 is comprised of upper and lower helical members 61*a*, 61*b*. The upper helical member 61*a* includes one end connected to one end of the lower helical member 61*b* through a connecting sheet 62. The connecting sheet 62 has its central portion connected to the shaft 51. The pair of helical members 60, 60 is provided rightwardly and leftwardly of a longitudinally central portion of the shaft 51 in symmetric relation to each other. Each of the upper and lower helical members 61*a*, 61*b* is comprised of a body 63 formed from a sheet of steel, and an outwardly projecting rubber member 64 mounted on the periphery of the body 63. The rubber member 64 may be replaced each time it gets worn.

The thrower 70 is disposed between the pair of helical members 60, 60. The thrower 70 is comprised of a pair of paddle members 71, 71. Each paddle member 71 is formed of a press-formed sheet of steel. The pair of paddle members 71, 71 includes flat proximal portions 72, 72. The paddle members 71, 71 are disposed with back sides of the flat proximal portions 72, 72 coupled together to thereby form the snow thrower 70.

As shown in FIG. 3, each of the flat proximal portions 72, 72 of the paddle members 71, 71 has a rectangular recessed portion 73 formed along a longitudinal direction of the shaft 51. When the pair of paddle members 71, 71 is coupled together with the rectangular recessed portions 73, 73 of the individual paddle members 71, 71 opposed to each other, there is defined a rectangular bearing portion 74 by the two recessed portions 73, 73. The rectangular shaft portion 51*b* positioned intermediately of the shaft 51 is inserted through such a bearing portion 74.

Figure 8:
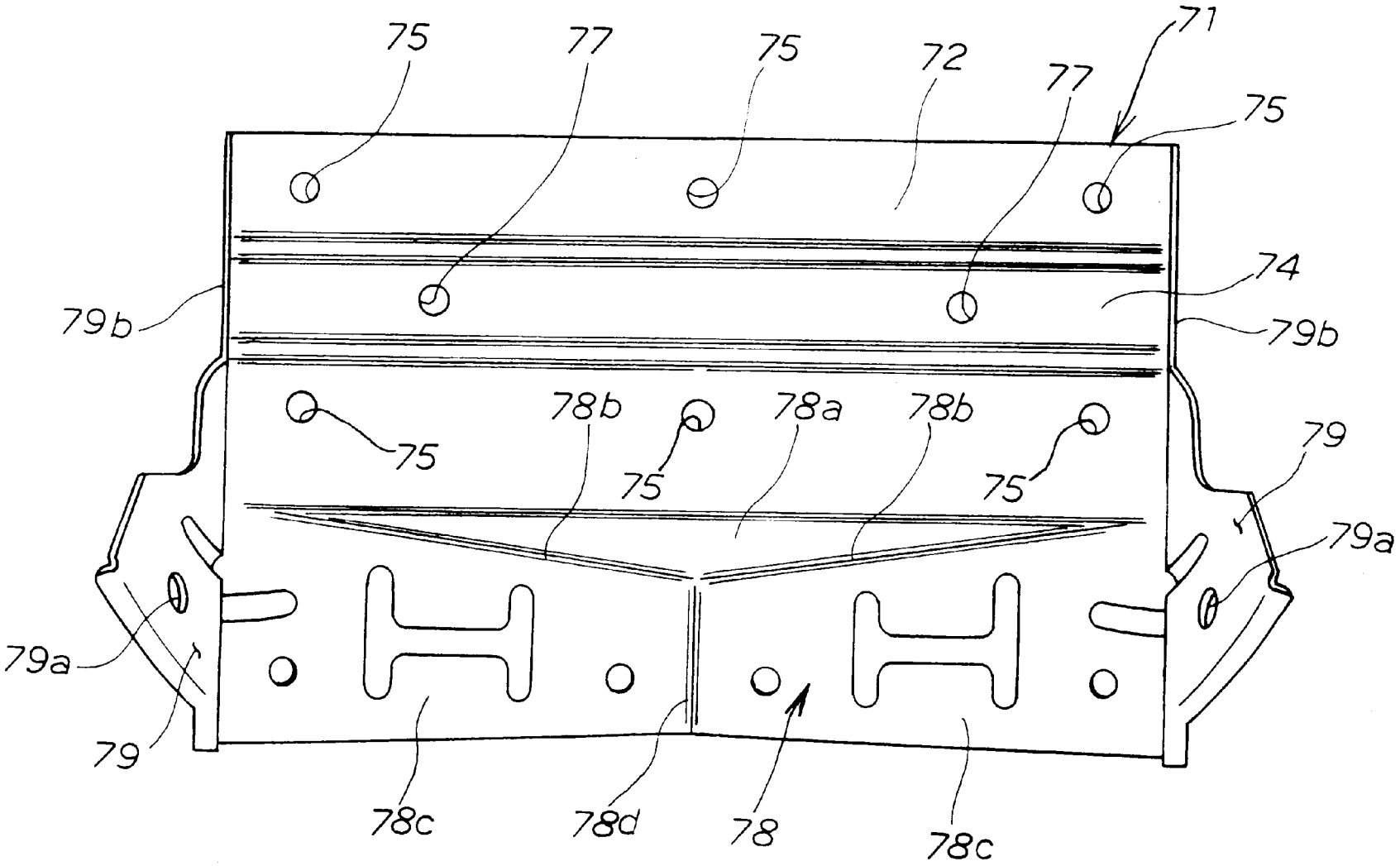
FIG. 8 is a plan view of a paddle member forming a snow thrower of the auger paddle shown in FIG. 7.

Referring to FIG. 8, the proximal portion 72 of the paddle member 71 has plural mounting apertures 75 formed along a longitudinal direction thereof and along the bearing portion 74. The pair of paddle members 71, 71 is coupled together by inserting bolts 76, 76 into the mounting apertures 75, as shown in FIG. 3. The bearing portion 74 has plural mounting apertures 77 formed along a longitudinal direction thereof. Since the thrower 70 is fixedly bolted to the rectangular shaft portion 51*b* through the mounting apertures 77, it becomes possible to prevent the thrower 70 from shifting longitudinally of the rectangular shaft portion 51*b*.

The paddle member 71 has a pocket portion 78. Snow collected at the paddle member 71 is temporarily held onto such a pocket portion 78. The pocket portion 78 is contiguous with the proximal portion 72 of the paddle member 71. The pocket portion 78 is inclined away from a flat surface of the proximal portion 72 and extends outwardly.

The pocket portion 78 includes an inverted triangle-shaped back wall 78*a* sloping downwardly from the proximal portion 72, and right and left bottom walls 78*c*, 78*c* extending outwardly from right and left sides 78*b*, 78*b* provided at a lower end portion of the back wall 78*a*. The pocket portion 78 has a valley portion 78*d* positioned centrally thereof. The right and left walls 78*c*, 78*c* meet each other at such a valley portion 78*d* and provide a large angle therebetween. In other words, the right and left bottom walls 78*c*, 78*c* are disposed to provide a V-shaped configuration in cooperation with each other.

Figure 9:
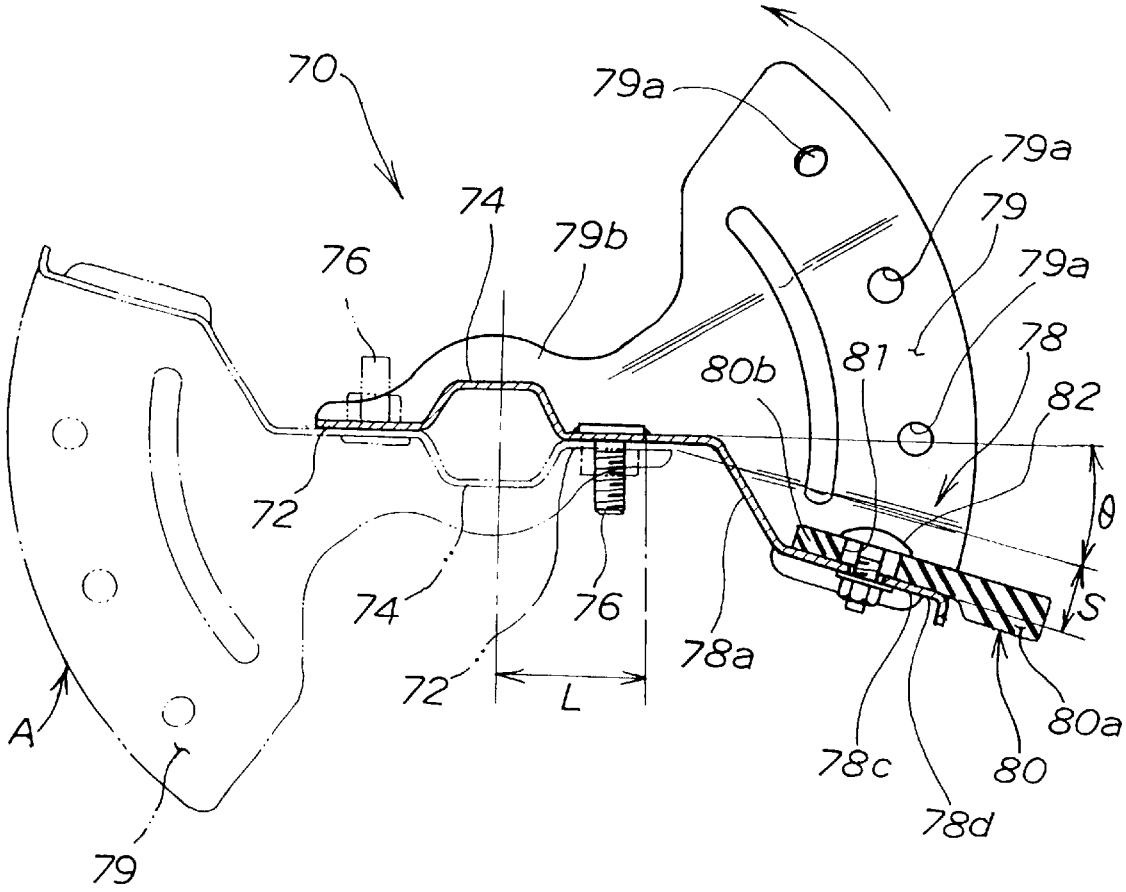
FIG. 9 is a cross-sectional view of the snow thrower with one paddle member shown in a solid line and another paddle member shown in a double-dot-and-dash line.

Turning to FIG. 9, when the auger paddle 50 (see FIG. 7) is set to rotate counterclockwise, as indicated by an arrow, the pocket portion 78 is inclined in a clockwise direction. More specifically, the pocket portion 78 is inclined at a predetermined angle or a lag angle 0 away from the flat surface of the proximal portion 72. The angle θ is, for example, of the order of 15 degrees. As shown in FIG. 9, the point of intersection of two lines providing the angle θ therebetween is provided on a side of the pocket portion 78. More specifically, such a point is positioned a distance L away from a center of the bearing portion 74. The valley portion 78*d* of the pocket portion 78 is positioned a distance S away from the line inclined at the angle θ to the flat surface of the proximal portion 72.

Reference is made to FIG. 6. On each of end portions of the right and left bottom walls 78*c*, 78*c* of the pocket portion 78, a mounting piece 79 for attaching the helical member thereto is mounted in such a manner as to extend upwardly and outwardly. The mounting piece 79 has an arc-shaped configuration. The helical member 60 provides an outer peripheral circle when viewed in side elevation, as shown in FIG. 3. The outer peripheral circle is concentric with a circle formed by the arc. The arc-shaped mounting piece 79 includes a semicircular portion forming therein plural mounting apertures 79*a*. As shown in FIG. 7, end portions of the upper and lower helical members 61*a*, 61*b*, which are opposite to the one ends connected to each other through the connecting sheet 62, are bolted to the mounting pieces 79, 79 through the mounting apertures 79*a*, 79*a*. Ribs 79*b* disposed oppositely from the semicircular portions of the mounting pieces 79, 79 are held in contact with the rectangular shaft portion 51*b*.

As shown in FIG. 7, the pocket portion 78 of the thrower 70 is opened outwardly and in the direction of rotation of the auger paddle 50 and is defined by the back wall 78*a*, the bottom walls 78*c*, 78*c*, and the right and left mounting pieces 79, 79.

The thrower 70 as shown by a double-dot-and-dash line A and a solid line in FIG. 9 has the pair of paddle members 71, 71 spaced 180 degrees away from each other. That is, the paddle members 71, 71 are coupled together with the bearing portion 74 provided midway therebetween. The illustrated embodiment employs the paddle member 71 made of a press-formed sheet of steel material.

The bottom walls 78*c*, 78*c* forming the pocket portion 78 of the thrower 70 have rubber members 80, 80 mounted on upper surfaces thereof, as shown in FIG. 9. Each rubber member 80 includes a thick distal end portion 80*a* bulging opposite to the direction of rotation of the auger paddle 50, and a thin proximal end portion 80b. The thin proximal end portion 80*b* of the rubber member 80 includes long apertures 81 formed along a direction perpendicular to the shaft 51. The rubber member 80 is secured to the bottom wall 78*c* by inserting bolts 82 through such long apertures 81. The aperture 81 is provided for adjusting a position of the rubber member 80 mounted on the bottom wall 78*c*. That is, when the distal end portion 80*a* of the rubber member 80 gets worn, the bolts 82 are loosened to move the rubber member 80 along the longitudinal direction of the aperture 81. Thus, the rubber member 80 can be mounted in place on the bottom wall 78*c*.

FIGS. 10 and 11 show how the auger paddle 50 of the machine is operated to remove snow.

As the machine 1 illustrated in FIG. 1 is propelled, the right and left helical members 60, 60 of the auger paddle 50 are rotated. At this time, the helical members 60, 60 guides snow, positioned forwardly of and below the auger housing 10, towards the thrower 70 provided centrally of the shaft 51. The snow thus guided to the snow thrower 70 is collected at the pocket portion 78. On the snow collected at the pocket portion 78 of the thrower 70, a centrifugal force produced by the rotation of the thrower 70 on the shaft 51 is exerted, as shown in FIG. 10. The snow is then thrown upwardly into the aperture 12*a* and then out of the shooter 29 as shown in FIG. 1. Since the shooter 29 can be turned and the guide corn 30 can be moved in the longitudinal direction of the shooter 29, a direction in which snow is thrown can be varied.

The pocket portion 78 of the thrower 70 is inclined in the direction opposite to the rotational direction of the auger paddle 50. That is, the pocket portion 78 is inclined at the angle θ to the flat surface of the proximal portion 72 of the paddle member 71, as shown in FIG. 10. Snow can thus be easily collected at the pocket portion 78. On the pocket portion 78 thus inclined at the angle θ away from the proximal portion 72, a centrifugal force is exerted to thereby throw the collected snow further. Snow failed to enter the aperture 12*a* impacts on the guide member 27 of the connecting member 20 and then falls to the auger paddle 50.

Obviously, various minor changes and modifications of the present invention are possible in the light of the above teaching. It is therefore to be understood that within the scope of the appended claims, the present invention may be practiced otherwise than as specifically described.

What is claimed is:

1. A snow shoveling machine comprising: an auger housing; an auger paddle disposed within the auger housing; and a motive power source for rotating the auger paddle when actuated; wherein the auger paddle collects snow and throws the collected snow out from a snow throwing aperture formed in the auger housing, and the auger housing comprises an upper half having the snow throwing aperture, a lower half separate from the upper half for supporting the auger paddle, and a connecting member for connecting the upper half and the lower half together, the connecting member being disposed forwardly of the snow throwing aperture and serving as a snow dropping guide.

2. A snow shoveling machine as claimed in claim 1; wherein the upper half of the auger housing is made of resin, the lower half is made of a metal, and the connecting member is provided within the auger housing in such a manner as to extend along a width of the auger housing.

3. A snow shoveling machine as claimed in claim 1; wherein the connecting member is disposed above the auger paddle, the connecting member is spaced from the auger paddle by a predetermined distance, and the connecting member has a surface extending forwardly and downwardly from a peripheral inner surface of the upper half to form the snow dropping guide.

4. A snow shoveling machine as claimed in claim 2; wherein the connecting member is disposed forwardly of and above the auger paddle, the connecting member is spaced from the auger paddle by a predetermined distance, and the connecting member has a surface extending forwardly and downwardly from a peripheral inner surface of the upper half to form the snow dropping guide.

5. A snow shoveling machine according to claim 1; further comprising a frame directly mounted to the auger housing for supporting the auger housing and the motive power source; a pair of wheels mounted to a lower portion of the frame; and a handle extending in an upwardly inclined manner in a rearward direction of the machine to permit an operator to push the machine.

6. A snow shoveling machine according to claim 1; wherein the auger paddle comprises a shaft rotatably supported by the lower half of the auger housing, a pair of helical members disposed on opposite sides of the shaft for urging snow toward a center of the auger paddle, and a snow thrower disposed between the helical members for throwing the snow upwardly toward the snow throwing aperture.

7. A snow shoveling machine according to claim 6; wherein the snow thrower comprises a pair of substantially flat portions extending radially outward from the shaft, and a pair of pocket portions for capturing snow and throwing the snow through the snow throwing aperture, each pocket portion extending radially outward from a respective flat portion and inclined with respect to the flat portion in a direction opposite to a direction of rotation of the snow thrower to provide a lag angle between the pocket portions and the flat portions.

8. A snow shoveling machine according to claim 7; wherein a bottom surface of the pocket portions have a substantially V-shaped configuration in a transverse direction thereof.

9. A snow shoveling machine according to claim 7; further comprising a rubber member mounted to the pocket portion, the rubber member being adjustable to move transversely of a bottom surface of the pocket portion.

10. A snow shoveling machine for collecting snow and throwing the snow out of a shooter, the machine comprising:

an auger paddle rotated by a drive source when the drive source is actuated; and an auger housing having the auger paddle rotatably accommodated therein and the shooter extending upwardly therefrom;

wherein the auger paddle comprises a shaft, a pair of helical members disposed on opposite sides of the shaft for carrying snow to a central portion of the auger paddle, and a snow thrower disposed at the central portion of the auger paddle positioned between the helical members for throwing the snow upwardly through the shooter; and wherein the snow thrower comprises a pair of paddle members coupled to the shaft, each of the paddle members having a flat proximal portion extending radially outward from the shaft and a generally V-shaped pocket portion contiguous with and extending outward from the flat proximal portion for temporarily holding therein snow collected at the paddle member, the pocket portion comprising an inverted triangle-shaped back wall sloping downward from the proximal portion and right and left bottom walls extending outward from left and right sides of a bottom portion of the back wall, the right and left bottom walls meeting together at a valley portion of the V-shaped pocket portion.

11. A snow shoveling machine as claimed in claim 10; wherein the bottom walls of the pocket portion are inclined with respect to the paddle members in a direction opposite to a direction of rotation of the auger paddle to thereby provide a lag angle between the paddle members and the bottom walls.

12. A snow shoveling machine as claimed in claim 11; further comprising a rubber member mounted to the bottom walls of the snow thrower, the rubber member being adjustable to move transversely of the bottom walls.

13. A snow shoveling machine as claimed in claim 10; further comprising a rubber member mounted to the bottom walls of the snow thrower, the rubber member being adjustable to move transversely of the bottom walls.

14. A snow shoveling machine according to claim 13; wherein the rubber member has a thin proximal end portion attached to the right and left bottom walls of the pocket portion, and a thick distal end portion projecting outward from the proximal end portion in a direction opposite the bottom walls, the thick distal end portion and bulging outward in a direction opposite to a direction of rotation of the auger paddle.

15. A snow shoveling machine according to claim 10; wherein the auger housing comprises an upper half formed of resin, a lower half separate from the upper half formed of metal, and a connecting member for connecting the upper and lower halfs, the connecting member being mounted within the auger housing so as to extend in a widthwise direction thereof.

16. A snow shoveling machine according to claim 15; wherein the connecting member is disposed forwardly of and above the auger paddle, is spaced from the auger paddle by a predetermined distance and extends forwardly and downwardly from a peripheral inner surface of the upper half so as to serve as a snow dropping guide for guiding snow that has not passed through the shooter onto the thrower.

17. A machine for picking up a material from a surface and ejecting the material, the machine comprising: an engine; an auger paddle rotatably driven by the engine for picking up the material and ejecting the material from an aperture; an auger housing for rotatably accommodating the auger paddle and defining the aperture, the auger housing having a supporting portion formed of metal for supporting the auger paddle and a non-supporting portion formed of resin that does not support the auger paddle; a dropping guide for guiding material that has not passed through the aperture onto the auger paddle; a frame mounted to the supporting portion of the auger housing and having a pair of wheels disposed at a bottom portion of the machine; and a handle extending upwardly and rearwardly of the auger housing for permitting movement of the machine across the surface.

18. A machine according to claim 17; wherein the supporting portion of the auger housing comprises a lower portion thereof, the non-supporting portion comprises an upper portion thereof, and the dropping guide comprises a connecting member for connecting the upper and lower portions and having a surface disposed proximate the aperture for guiding picked-up material that has not been ejected from the aperture toward the auger paddle so that the material may then be ejected from the aperture.

19. A machine according to claim 17; wherein the auger paddle comprises a shaft rotatably driven by the engine, helical auger members disposed on opposite ends of the shaft for urging the material inward to a central portion of the shaft, and a paddle portion disposed at the central portion of the shaft for throwing the material through the aperture.

20. A machine according to claim 19; wherein the paddle portion comprises opposed paddle members extending radially outward from the shaft and having a bottom surface concavely extending from one side to another so that a central part thereof serves as a throwing portion for picking up and throwing collected material upwardly through the aperture.

21. A machine according to claim 17; wherein the auger paddle comprises a shaft, and a thrower disposed at a central portion of the shaft for throwing the material upwardly, the thrower comprising a pair of paddle members coupled to the shaft, each of the paddle members having a flat proximal portion extending radially outward from the shaft and a generally V-shaped pocket portion contiguous with and extending outward from the flat proximal portion for temporarily holding therein material collected at the paddle member, the pocket portion comprising an inverted triangle-shaped back wall sloping downward from the proximal portion and right and left bottom walls extending outward from left and right sides of a bottom portion of the back wall, the right and left bottom walls meeting together at a valley portion of the V-shaped pocket portion.

22. A machine according to claim 21; wherein the auger paddle further comprises a pair of helical members disposed on opposite sides of the shaft for urging material to the central portion of the shaft.

23. A machine according to claim 21; wherein the bottom walls of the pocket portion are inclined with respect to the proximal portions in a direction opposite a direction of rotation of the auger paddle to provide a lag angle such that when the thrower rotates the phase of the bottom walls is shifted by the lag angle so that a centrifugal force applied to the pocket portion during rotation of the thrower causes thrown material to be thrown further than if the lag angle was not provided.

24. A machine according to claim 21; further comprising a rubber member mounted to the right and left bottom walls of the pocket portion, the rubber member being adjustable to move transversely of the bottom walls so that the position of the rubber member can be adjusted when it becomes worn.

25. A machine according to claim 24; wherein the rubber member has a thin proximal end portion attached to the right and left bottom walls of the pocket portion, and a thick distal end portion projecting outward from the bottom walls, the thick distal end portion being larger in thickness than the proximal end portion and bulging outward in a direction opposite a direction of rotation of the auger paddle.

26. A machine according to claim 17; further comprising a base frame for supporting the engine, the auger housing and the auger paddle, a fuel tank for supplying fuel to the engine and having an inlet, a cover for covering the engine and the fuel tank and having an opening in communication with the inlet, a handle connected extending in an upwardly inclined manner in a rearward direction of the machine to permit an operator to operate the machine, at least two wheels mounted to opposite sides of the base frame, and a throttle lever for controlling a cable linked to a carburetor of the engine to control the engine, the throttle lever rotatably supported on the handle.

27. A machine according to claim 26; further comprising a driving pulley mounted to an output shaft of the engine, a driven pulley mounted to a shaft of the auger paddle for rotating the auger paddle, and a belt connecting the driving pulley and the driven pulley.

28. A machine according to claim 27; wherein the auger housing has a recessed portion for accommodating the belt and driven pulley.

29. A machine according to claim 17; further comprising a scraper mounted to a lower end of the auger housing for leveling an irregular surface.

* * * * *